United States Patent [19]

Habel et al.

[11] Patent Number: 4,457,278

[45] Date of Patent: Jul. 3, 1984

[54] FUEL SUPPLY SYSTEM

[75] Inventors: Georg Habel, Brüggen; Rolf-Peter Heidemanns, Neuss; Hans-Jürgen Müller, Gelsenkirchen, all of Fed. Rep. of Germany

[73] Assignee: Pierburg GmbH & Co., KG, Neuss, Fed. Rep. of Germany

[21] Appl. No.: 479,215

[22] Filed: Mar. 28, 1983

[30] Foreign Application Priority Data

Apr. 1, 1982 [DE] Fed. Rep. of Germany ..... 3212126

[51] Int. Cl.[3] ..... F02M 7/08

[52] U.S. Cl. ..... 123/438; 123/432; 261/26; 261/34 B; 261/DIG. 74

[58] Field of Search ..... 123/308, 340, 432, 437, 123/438, 431; 261/26, 34 B, 39 R, 39 B, DIG. 74, 27

[56] References Cited

U.S. PATENT DOCUMENTS

| | | | |
|---|---|---|---|
| 4,088,102 | 5/1978 | Kato | 261/34 B |
| 4,271,801 | 6/1981 | Yamakawa et al. | 123/308 |
| 4,271,803 | 6/1981 | Nakanishi et al. | 123/308 |
| 4,303,048 | 12/1981 | Nishio | 123/438 |
| 4,361,123 | 11/1982 | Hori et al. | 123/432 |
| 4,364,354 | 12/1982 | Kosuge et al. | 123/437 |

*Primary Examiner*—William A. Cuchlinski, Jr.
*Attorney, Agent, or Firm*—Toren, McGeady and Stanger

[57] ABSTRACT

A fuel supply system for a mixture-compressing internal combustion engine employs a controllable differential pressure for the removal of air from a main air duct into a carrier air duct for proportioning the fuel to be used. The fuel system includes a fuel proportioning device and a vane pump for withdrawing a carrier air flow from the main air duct and for transporting the fuel through feed lines to the internal combustion engine. The pressure of the air at the fuel outlet and the differential pressure for fuel proportioning is controlled by a differential pressure valve located in the carrier air duct spaced from the main air duct. The differential pressure valve has a diaphragm dividing the interior of the valve into chambers with one side of the diaphragm acted upon by the air pressure in the carrier duct between the differential pressure valve and the main air duct. The other side of the diaphragm is acted upon by the pressure in the carrier air duct downstream from the differential pressure valve and also by a variable force depending on the parameters of the engine. To prevent pulsations in the air flow from disadvantageously affecting the differential pressure valve, the diaphragm in the valve is separated by a partition from a space in which such pulsations are effective. The air pressure in the carrier air duct upstream from the differential pressure valve acts in the space and the partition has a nozzle for admitting the air pressure to the one side of the diaphragm.

6 Claims, 1 Drawing Figure

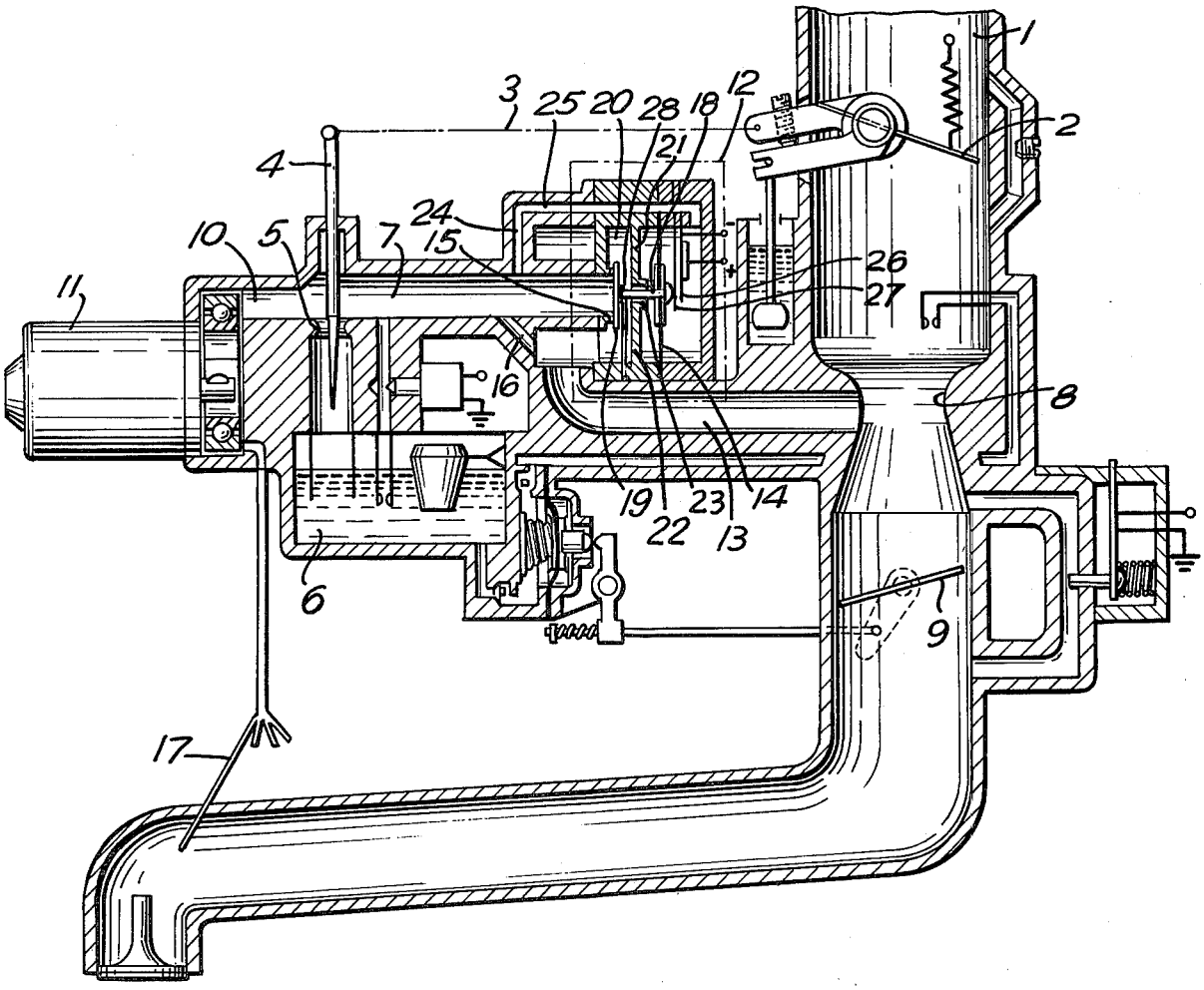
1
2
3
4
5
6
7
8
9
10
11
12
13
14
15
16
17
18
19
20
21
22
23
24
25
26
27
28

FUEL SUPPLY SYSTEM

SUMMARY OF THE INVENTION

The present invention is directed to a fuel supply system for a mixture-compressing internal combustion engine with a carrier air duct branched off from the main air duct at a location between a throttle valve and an air quantity measuring valve, upstream, from the throttle valve within the main air duct. A fuel metering nozzle discharges into the carrier air duct. A proportioning valve is located in the fuel metering nozzle and the proportioning valve is adjustable in dependence on the air quantity measuring valve located in the main air channel. A pump is associated with the carrier air duct downstream from the fuel metering nozzle and distributor ducts extend from the carrier air duct downstream of the pump and are connected to suction nozzles located adjacent the inlet valves of the internal combustion engine. A differential pressure valve is located within the controls the flow in the carrier air duct. The differential pressure valve is located upstream from the fuel metering nozzle and is adjustable based on the operating parameters of the engine. The differential pressure valve has an effective surface or diaphragm located within the valve housing and one side of the diaphragm is acted upon by a variable force and the air pressure in the carrier air duct in the region of the fuel metering nozzle and the other side of the diaphragm is acted upon by the air pressure in the carrier air duct upstream from the differential pressure valve.

Such a fuel supply system is disclosed in German Pat. No. 30 03 386. In this known system there is the disadvantage, due to air pulsations occurring in the carrier air duct which may develop during full load operation from the suction pipe of the internal combustion engine into the carrier air duct, that the maintenance of the differential pressure for determining the fuel quantity is not effective.

Therefore, it is the primary object of the present invention to provide the fuel supply system so that the differential pressure valve in the carrier air duct, required for the proper determination of the fuel quantity, is not affected by pulsation in the carrier air channel upstream from the differential pressure valve.

In accordance with the present invention, in the fuel supply system of the type mentioned above, the effective surface within the differential pressure valve is separated by a partition from the chamber in which the air pressure of the carrier air duct upstream of the flow opening from the valve is active. The partition is provided with a nozzle and a valve stem opening. With this arrangement, the effective surface of the differential pressure valve in the form of a diaphragm is not acted upon directly by the air pressure in the carrier air duct upstream from the flow opening, rather the air pressure acts on the diaphragm via the nozzle in the partition and the nozzle affords a dampening effect.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

The drawing is a schematic sectional view of a fuel supply system embodying the present invention.

DETAIL DESCRIPTION OF THE INVENTION

In the drawing, the fuel supply system includes a main air channel or duct 1 extending from an inlet end, not shown, to an outlet end at the inlet valves to an internal combustion engine, not shown. An air quantity measuring valve 2 is located in the main air channel 1 and it is connected via linkage 3 to a fuel proportioning needle or valve 4 with a shaped surface. The proportioning needle 4 extends into and interacts with a fuel nozzle 5 which opens into an immersion tube, not further described, extending downwardly into a float chamber 6. The fuel nozzle 5 discharges fuel from the float chamber 6 into a carrier air channel or duct 7. At its upstream end, the carrier air duct is connected to the main air duct 1 at a Venturi 8 located downstream from the air quantity measuring valve 2 and upstream from a throttle valve 9. At its downstream end, the carrier air duct 7 has a duct portion 10 extending between the fuel nozzle 5 and the inlet to a wet-running, electrically operated vane pump 11. A differential pressure valve 12 is positioned in the carrier air duct 7 intermediate its upstream and downstream ends. The differential pressure valve 12 is a flat seat valve and is acted on one side via the air pressure in duct portion 13 which extends between the upstream end of the carrier air duct and the differential pressure valve. The negative air pressure at the Venturi 8 is active in the duct portion 13. The housing of the differential pressure valve 12 is divided by a diaphragm 14 into two separate spaces or chambers. In one of these chambers the air pressure in the duct portion 13 acts against the diaphragm and in the other chamber the air pressure in the carrier air duct 7 between the differential pressure valve 12 and the proportioning device formed by the needle or valve 4 and the fuel nozzle 5 acts against the diaphragm. A flow opening 15 is provided between the differential pressure valve 12 and the downstream portion of the carrier air duct extending toward the nozzle 5. A bypass channel 16, is located between the upstream duct portion 13 and the downstream section of the carrier air duct and serves for emergency operation for providing a flow of fuel in the direction toward the Venturi 8 in the main air duct 1. During such emergency operation, for instance if there is a failure of the pump 11, the fuel from the flow chamber 6 passes through the nozzle 5 and flows through the carrier air duct 7 by way of the bypass channel 16 into the main air duct 1 and then on to the inlet valves of the internal combustion engine. During normal operation, the fuel is directed through the feed lines 17 extending from the outlet of pump 11 to the region of the inlet valves. The differential pressure valve 12 includes a valve plate 19 on the upstream side of the flow opening 15. The valve plate 19 is connected with the diaphragm 14 via a valve stem 18. The valve plate 19 is located in a chamber 20 which is open to the downstream part of the duct portion 13 of the carrier air duct 7. Chamber 20 is separated from the valve housing space containing the diaphragm 14 by a partition 21. The partition 21 has a nozzle connecting the chamber 20 with the chamber or space on one side of the diaphragm 14. Further, the valve stem 18 extends through an opening 23 so that the diaphragm effects the displacement of the valve plate 19 and the opening and closing of the flow opening 15 into the downstream portion of the carrier air duct 7. The nozzle 22 admits the air pressure from the chamber 20 through the partition 21 into the space or chamber on one side of the diaphragm 14. The nozzle 22 has a dampening effect on the air pressure admitted to the diaphragm so that any pulsations in the air pressure existing in the upstream duct portion 13 does not have a disadvantageous effect on the operation of the diaphragm 14. On the opposite side of the diaphragm 14 from the partition 21, the air pressure in the carrier air duct 7 downstream from the differential pressure valve 12 acts against the diaphragm through a bypass line 24, 25.

On the side of the diaphragm 14 away from the partition 21, in addition to the air pressure active in the downstream portion of the carrier air duct 7, a variable force acts on the diaphragm by means of bimetallic elements 26, 27. Moreover, a bimetallic spring 28 engages the valve stem 18 within the chamber 20 and provides temperature compensation.

While specific embodiments of the invention have been shown and described in detail to illustrate the application of the inventive principles, it will be understood that the invention may be embodied otherwise without departing from such principles.

We claim:

1. A fuel supply system for a mixture-compressing internal compression engine, comprising a main air duct arranged to deliver air to the inlet valves of the engine, a throttle valve located within said main air duct, an air quantity measuring valve located in said main duct upstream from the throttle valve, a carrier air duct connected at one end to said main air duct at a location between said air quantity measuring valve and said throttle valve, a fuel metering nozzle opening into said carrier air duct at a location therein spaced from said main air duct, a proportioning valve positioned in said fuel metering nozzle, means connecting said air quantity measuring valve and said proportioning valve for controlling said proportioning valve, a pump located in said carrier air duct downstream from said fuel metering nozzle, and suction means for conveying fuel from said pump to the inlet valves of the engine, a differential pressure valve connected in said carrier air duct for controlling the flow of carrier air, said differential pressure valve is located in said carrier air duct upstream from said fuel metering nozzle and downstream from said main air duct and said differential pressure valve is adjustable in dependence on operating paramaters, said differential pressure valve having a diaphragm with one side of said diaphragm acted upon by a variable force and the air pressure in said carrier air duct in the region between said fuel metering nozzle and said differential pressure valve, and the other side of said diaphragm acted upon by the air pressure in said carrier air duct upstream from said differential pressure valve, wherein the improvement comprises said differential pressure valve includes a housing containing said diaphragm so that said diaphragm divides the interior of said housing into a first chamber and a second chamber, a partition located within said housing in said first chamber and dividing said first chamber into a first subchamber containing said diaphragm and a second subchamber open to said carrier air duct and separated from said diaphragm by said partition, said housing having a flow opening communicating with said carrier air duct for providing flow of the carrier air from upstream of said differential pressure valve to said carrier air duct downstream of said differential pressure valve, said partition has a nozzle therethrough communicating between said first and second subchambers, and the air pressure of said carrier air duct upstream of said differential pressure valve acts within said second subchamber.

2. A fuel supply system, as set forth in claim 1, wherein an emergency bypass duct interconnects said carrier air duct downstream from said differential pressure valve with said carrier air duct upstream from said differential pressure valve.

3. A fuel supply system, as set forth in claim 1, wherein said flow opening in said housing opens from said second subchamber into said carrier air duct downstream from said differential pressure valve, a valve plate forming a closure for said flow opening, a valve stem interconnecting said diaphragm and said valve plate with said valve stem extending through said partition.

4. A fuel supply system, as set forth in claim 3, including a second bypass duct interconnecting said carrier air duct downstream from said flow opening with said second chamber in said housing.

5. A fuel supply system, as set forth in claim 4, wherein means are located within said second chamber for providing a variable force acting on said diaphragm.

6. A fuel supply system, as set forth in claim 5, including a bimetallic spring located within said second subchamber in engagement with said valve stem for providing temperature compensation.

* * * * *